US010964249B2

(12) United States Patent
Ahn

(10) Patent No.: US 10,964,249 B2
(45) Date of Patent: Mar. 30, 2021

(54) SOURCE DRIVING CIRCUIT

(71) Applicant: Silicon Works Co., Ltd., Daejeon (KR)

(72) Inventor: Yong Sung Ahn, Daejeon (KR)

(73) Assignee: Silicon Works Co., Ltd., Daejeon-si (KR)

( * ) Notice: Subject to any disclaimer, the term of this patent is extended or adjusted under 35 U.S.C. 154(b) by 0 days.

(21) Appl. No.: 16/717,641

(22) Filed: Dec. 17, 2019

(65) Prior Publication Data

US 2020/0202765 A1 Jun. 25, 2020

(30) Foreign Application Priority Data

Dec. 24, 2018 (KR) ..... 10-2018-0168328

(51) Int. Cl.
*G09G 3/20* (2006.01)

(52) U.S. Cl.
CPC ... *G09G 3/2003* (2013.01); *G09G 2310/0275* (2013.01); *G09G 2310/0291* (2013.01); *G09G 2310/0297* (2013.01)

(58) Field of Classification Search
CPC .. G09G 3/20; G09G 5/10; G09G 3/32; G09G 3/3677; G09G 2320/08; G09G 2330/00; G09G 2330/04
See application file for complete search history.

(56) References Cited

U.S. PATENT DOCUMENTS 5,973,660 A * 10/1999 Hashimoto ..... G09G 3/2011 345/98
6,424,219 B1 * 7/2002 Kato ..... H03F 3/3023 330/255
7,551,030 B2 * 6/2009 An ..... H03F 3/3023 330/255
2003/0231191 A1 * 12/2003 Glen ..... G09G 5/363 345/690
2007/0018686 A1 * 1/2007 Yu ..... H04L 25/0278 326/83
2007/0182690 A1 * 8/2007 Lin ..... G09G 3/3611 345/100
2009/0040165 A1 * 2/2009 Shimatani ..... H03F 3/45179 345/98

(Continued)

FOREIGN PATENT DOCUMENTS

KR 2017-0070691 A 6/2017
KR 2017-0100923 A 9/2017

(Continued)

*Primary Examiner* — Olga V Merkoulova
(74) *Attorney, Agent, or Firm* — Polsinelli PC

(57) ABSTRACT

A source driving circuit including source channels each of which includes a source amplifier is disclosed. The source amplifier includes an internal amplifier configured to output a first pull-up signal and a first pull-down signal in response to a first gamma signal; an output circuit configured to output a first source driving signal in response to the first pull-up signal and the first pull-down signal; and first and second switch circuits connecting the internal amplifier and the output circuit, and configured to transfer the first pull-up signal and the first pull-down signal corresponding to the first gamma signal or a second pull-up signal and a second pull-down signal corresponding to a second gamma signal of another source channel, to the output circuit.

11 Claims, 4 Drawing Sheets

(56) References Cited

U.S. PATENT DOCUMENTS

| | | | | |
|---|---|---|---|---|
| 2009/0167667 | A1* | 7/2009 | Suzuki | G09G 3/3688 345/96 |
| 2010/0128027 | A1* | 5/2010 | Nakayama | G09G 3/3688 345/214 |
| 2010/0231569 | A1* | 9/2010 | Shimatani | G09G 3/3688 345/211 |
| 2016/0070386 | A1* | 3/2016 | Yamamoto | G06F 3/04166 345/174 |
| 2018/0061307 | A1* | 3/2018 | Inoue | G09G 3/3275 |
| 2018/0144706 | A1* | 5/2018 | Cho | G09G 3/3688 |
| 2018/0286317 | A1* | 10/2018 | Park | G09G 3/2007 |
| 2019/0108798 | A1* | 4/2019 | Ishihara | G09G 3/3413 |

FOREIGN PATENT DOCUMENTS

| | | | |
|---|---|---|---|
| KR | 2018-0056948 | A | 5/2018 |
| KR | 2018-0078996 | A | 7/2018 |
| KR | 2018-0121328 | A | 11/2018 |

* cited by examiner

100

| | | | | | | | | |
|---|---|---|---|---|---|---|---|---|
| HL1 → | R | G | B | G | R | G | B | G |
| HL2 → | B | G | R | G | B | G | R | G |
| | R | G | B | G | R | G | B | G |
| | B | G | R | G | B | G | R | G |

SOURCE DRIVING CIRCUIT

CROSS-REFERENCE TO RELATED APPLICATIONS

The present application claims priority to Korean Application No. 10-2018-0168328, filed Dec. 24, 2018 the contents of which are hereby incorporated by reference as set for fully herein.

BACKGROUND

1. Technical Field

Various embodiments generally relate to a display device, and more particularly, to a source driving circuit for driving a display panel.

2. Related Art

In general, a display device includes a source driving circuit and a display panel, and the source driving circuit converts digital image data into a source driving signal and provides the source driving signal to the display panel.

A conventional source driving circuit changes panel driving information by switching the gamma of a pixel in conformity with a sub-pixel through an output multiplexer positioned at an output terminal of a source amplifier of a source channel or by switching an output of the source amplifier. Also, the source driving circuit changes the panel driving information by switching of the source channel, through configuring gamma circuits corresponding to R, G and B, respectively. The panel driving information may be defined as source driving signals corresponding to R, G and B.

Meanwhile, as a time required for driving one horizontal line is shortened due to a demand for a high-resolution display, the influence of the resistance of a switch positioned at the output terminal of the source amplifier is becoming greater. In the conventional art, in order to reduce the influence of the resistance of the switch positioned at the output terminal of the source amplifier, the size of the switch is increased. Due to this fact, a problem arises in that the area of the source driving circuit increases.

Further, in the conventional art, since the gamma circuits corresponding to R, G and B, respectively, are configured, problems may be encountered in that the number of wirings which are connected between the gamma circuits and source terminals of respective channels increases and a chip area increases due to the presence of the respective gamma circuits.

As a consequence, problems may be encountered in that the resistance of the switch positioned at the output terminal of the source amplifier may affect the settling time of the source amplifier and that, in the case where the size of the switch is increased to reduce the influence of the resistance of the switch, the size of a chip in which the source driving circuit is integrated increases.

SUMMARY

Various embodiments are directed to a source driving circuit capable of minimizing a reduction in settling time and an increase in chip area by switch resistance.

Also, various embodiments are directed to a source driving circuit capable of reducing a chip area by implementing the same operation through using two gamma circuits instead of gamma circuits corresponding to R, G and B, respectively.

In an embodiment, a source driving circuit may include source channels each of which includes a source amplifier. The source amplifier may include: an internal amplifier configured to output a first pull-up signal and a first pull-down signal in response to a first gamma signal; an output circuit configured to output a first source driving signal in response to the first pull-up signal and the first pull-down signal; and first and second switch circuits connecting the internal amplifier and the output circuit or another source channel and the output circuit, and configured to transfer the first pull-up signal and the first pull-down signal corresponding to the first gamma signal or a second pull-up signal and a second pull-down signal corresponding to a second gamma signal of the another source channel, to the output circuit.

In an embodiment, a source driving circuit may include: a first source amplifier configured to receive a first gamma signal, and change a first source driving signal to a signal corresponding to 'red and green' or 'blue and green' by using a first pull-up signal and a first pull-down signal corresponding to the first gamma signal or a second pull-up signal and a second pull-down signal corresponding to a second gamma signal; and a second source amplifier configured to receive a second gamma signal, and change a second source driving signal to a signal corresponding to 'blue and green' or 'red and green' by using the second pull-up signal and the second pull-down signal corresponding to the second gamma signal or the first pull-up signal and the first pull-down signal corresponding to the first gamma signal.

In an embodiment, A source driving circuit may include: a first source channel configured to output a first source driving signal to a display panel; a second source channel configured to output a second source driving signal to the display panel; a first gamma circuit configured to output first gamma values to the first source channel; and a second gamma circuit configured to output second gamma values to the second source channel, wherein the first gamma circuit sets the first gamma values to values corresponding to red or green depending on a first switching operation of a first demultiplexer of the display panel corresponding to the first source channel, and wherein the second gamma circuit sets the second gamma values to values corresponding to blue or green depending on a second switching operation of a second demultiplexer of the display panel corresponding to the second source channel.

In an embodiment, a source driving circuit may include: a first gamma circuit configured to set first gamma values to values corresponding to red or green; a second gamma circuit configured to set second gamma values to values corresponding to blue or green; a first digital-analog converter configured to output one of the first gamma values of the first gamma circuit as a first gamma signal, and formed in a first source channel; and a second digital-analog converter configured to output one of the second gamma values of the second gamma circuit as a second gamma signal, and formed in a second source channel.

According to the embodiments of the disclosure, by removing a switch terminal positioned at an output terminal of a source amplifier, it is possible to eliminate a settling time issue by the influence of switch resistance.

Also, according to the embodiments of the disclosure, by implementing, in a source amplifier, a switch for changing a source driving signal of a channel, it is possible to minimize a reduction in settling time and an increase in chip area in the source amplifier.

Further, according to the embodiments of the disclosure, since the same operation is implemented by using two gamma circuits instead of gamma circuits corresponding to R, G and B, respectively, it is possible to reduce the chip area of a source driving circuit.

DETAILED DESCRIPTION

Figures 1, 2:
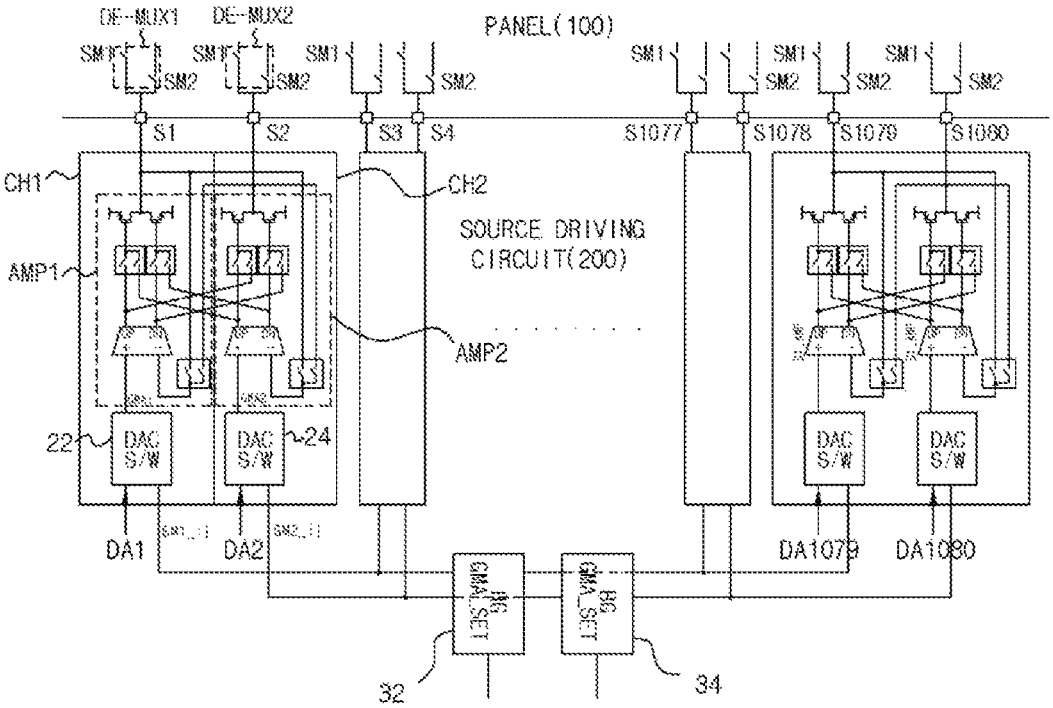
FIG. 1 is a diagram illustrating a representation of an example of pixels of a display panel for implementation of rendering in accordance with an embodiment of the disclosure.
FIG. 2 is a diagram illustrating a representation of an example of a source driving circuit enabling implementation of rendering in accordance with an embodiment of the disclosure.

Hereinafter, embodiments of the disclosure will be described in detail with reference to the accompanying drawings. The terms used herein and in the claims shall not be construed as being limited to general or dictionary meanings and shall be interpreted based on the meanings and concepts corresponding to technical aspects of the disclosure.

Embodiments described herein and configurations illustrated in the drawings are preferred embodiments of the disclosure, and, because they do not represent all of the technical spirit of the disclosure, there may be various equivalents and modifications that can be made thereto at the time of filing the present application.

Recently, in a display device, a high resolution and a wide aspect ratio are required, and, as a game or the like requiring a fast screen is becoming popular, high-speed driving is also required. Due to this fact, there is a need for a source driving circuit which drives a large number of columns while driving one horizontal line for a shorter time.

To this end, the number of source channels of a source driving circuit is reduced by using a rendering technique and demultiplexers of a display panel. However, attributable to the fact that a time required for driving one horizontal line is shortened, the influence of switch resistance is becoming greater.

Embodiments of the disclosure may provide a source driving circuit capable of minimizing a reduction in settling time and an increase in chip area by the influence of switch resistance, and may provide a source driving circuit capable of reducing a chip area by implementing the same operation through using two gamma circuits instead of gamma circuits corresponding to R, G and B, respectively.

FIG. 1 is a diagram illustrating a representation of an example of pixels of a display panel for implementation of rendering in accordance with an embodiment of the disclosure.

Referring to FIG. 1, in a display panel 100, red, green, blue and green pixels are repeatedly arranged on a first horizontal line HL1, and blue, green, red and green pixels are repeatedly arranged on a second horizontal line HL2. The number of these pixels may be determined depending on a resolution of the display panel 100.

As the display panel 100 has a high resolution, a larger number of pixels are arranged. A source driving circuit needs to include a large number of source channels to drive the high-resolution display panel 100. The source driving circuit may drive the high-resolution display panel 100 with a small number of source channels by using a rendering technique.

In order to drive the display panel 100 illustrated in FIG. 1 by the rendering technique, the source driving circuit needs to change a source driving signal of red and green to a source driving signal of blue and green or change a source driving signal of blue and green to a source driving signal of red and green for one source channel according to change in a horizontal line.

Since the source driving circuit changes a source driving signal to 'red and green' or 'blue and green' in one source channel, it is possible to drive the high-resolution display panel 100 with a small number of source channels.

FIG. 2 is a diagram illustrating a representation of an example of a source driving circuit 200 enabling implementation of rendering in accordance with an embodiment of the disclosure.

Referring to FIG. 2, a display device includes the source driving circuit 200 and a display panel 100, and the source driving circuit 200 includes a plurality of source channels and first gamma circuit (RG GMA_SET) 32 and second gamma circuit (BG GMA_SET) 34. Hereinbelow, for the sake of convenience in explanation, the source driving circuit 200 will be described based on the configurations and operations of the first source channel CH1 and the second source channel CH2 among the source channels.

The first gamma circuit 32 outputs first gamma values GM1_*ij* to the first source channel CH1. The first gamma circuit 32 changes the first gamma values GM1_*ij* to values corresponding to red or green in conformity with a switching operation of a first demultiplexer DE-MUX1 of the display panel 100 corresponding to the first source channel CH1.

The second gamma circuit 34 outputs second gamma values GM2_*ij* to the second source channel CH2. The second gamma circuit 34 changes the second gamma values GM2_*ij* to values corresponding to blue or green in conformity with a switching operation of a second demultiplexer DE-MUX2 of the display panel 100 corresponding to the second source channel CH2.

The first source channel CH1 selects one of the first gamma values GM1_*ij* as a first gamma signal GMA1 in response to a first digital image signal DA1, and provides the first gamma signal GMA1 or a second gamma signal GMA2, selected by the second source channel CH2, to the display panel 100 as a first source driving signal S1. The first gamma signal GMA1 is a signal corresponding to red or green set by the first gamma circuit 32, and the second gamma signal GMA2 is a signal corresponding to blue or green set by the second gamma circuit 34.

The second source channel CH2 selects one of the second gamma values GM2_*ij* as the second gamma signal GMA2 in response to a second digital image signal DA2, and provides the second gamma signal GMA2 or the first gamma signal GMA1, selected by the first source channel CH1, to the display panel 100 as a second source driving signal S2.

The first source channel CH1 outputs the first source driving signal S1 as a value corresponding to 'red and green' or 'blue and green' to the first demultiplexer DE-MUX1 of the display panel 100, to drive the rendering technique according to change in a horizontal line of the display panel 100.

The second source channel CH2 outputs the second source driving signal S2, as a value corresponding to 'blue and green' or 'red and green,' to the second demultiplexer DE-MUX2 of the display panel 100, to drive the rendering technique according to change in a horizontal line of the display panel 100.

The first source channel CH1 includes a first digital-analog converter (DAC S/W) 22 and a first source amplifier AMP1.

The first digital-analog converter 22 selects one of the first gamma values GM1_*ij* as the first gamma signal GMA1 in response to the first digital image signal DA1, and provides the first gamma signal GMA1 to the first source amplifier AMP1.

The first source amplifier AMP1 receives the first gamma signal GMA1, and outputs the first source driving signal S1 in response to signals UP and DN corresponding to the first gamma signal GMA1 or the second gamma signal GMA2 provided from a second source amplifier AMP2 of the second source channel CH2. The first source amplifier AMP1 provides the first source driving signal S1, corresponding to 'red and green' or 'blue and green' depending on a switching operation of an internal switch circuit, to the display panel 100.

The second source channel CH2 includes a second digital-analog converter (DAC S/W) 24 and the second source amplifier AMP2.

The second digital-analog converter 24 selects one of the second gamma values GM2_*ij* as the second gamma signal GMA2 in response to the second digital image signal DA2, and provides the second gamma signal GMA2 to the second source amplifier AMP2.

The second source amplifier AMP2 receives the second gamma signal GMA2, and outputs the second source driving signal S2 in response to signals UP and DN corresponding to the second gamma signal GMA2 or the first gamma signal GMA1 provided from the first source amplifier AMP1 of the first source channel CH1. The second source amplifier AMP2 provides the second source driving signal S2, corresponding to 'blue and green' or 'red and green' depending on a switching operation of an internal switch circuit, to the display panel 100. Similar with the first source channel CH1 and the second source channel CH2, the remaining source channels output corresponding source driving signals (for example, the source driving signals S3, S4, . . . , S1077, S1078, S1079 and S1080) in response to corresponding digital image signals (for example, the third digital image signal, the fourth digital image signal, . . . , the 1079-th digital image signal DA1079 and the 1080-th digital image signal DA1080).

Detailed descriptions for the configurations and operations of the first and second source amplifiers AMP1 and AMP2 will be made later with reference to FIGS. 4 and 5.

Figure 3:
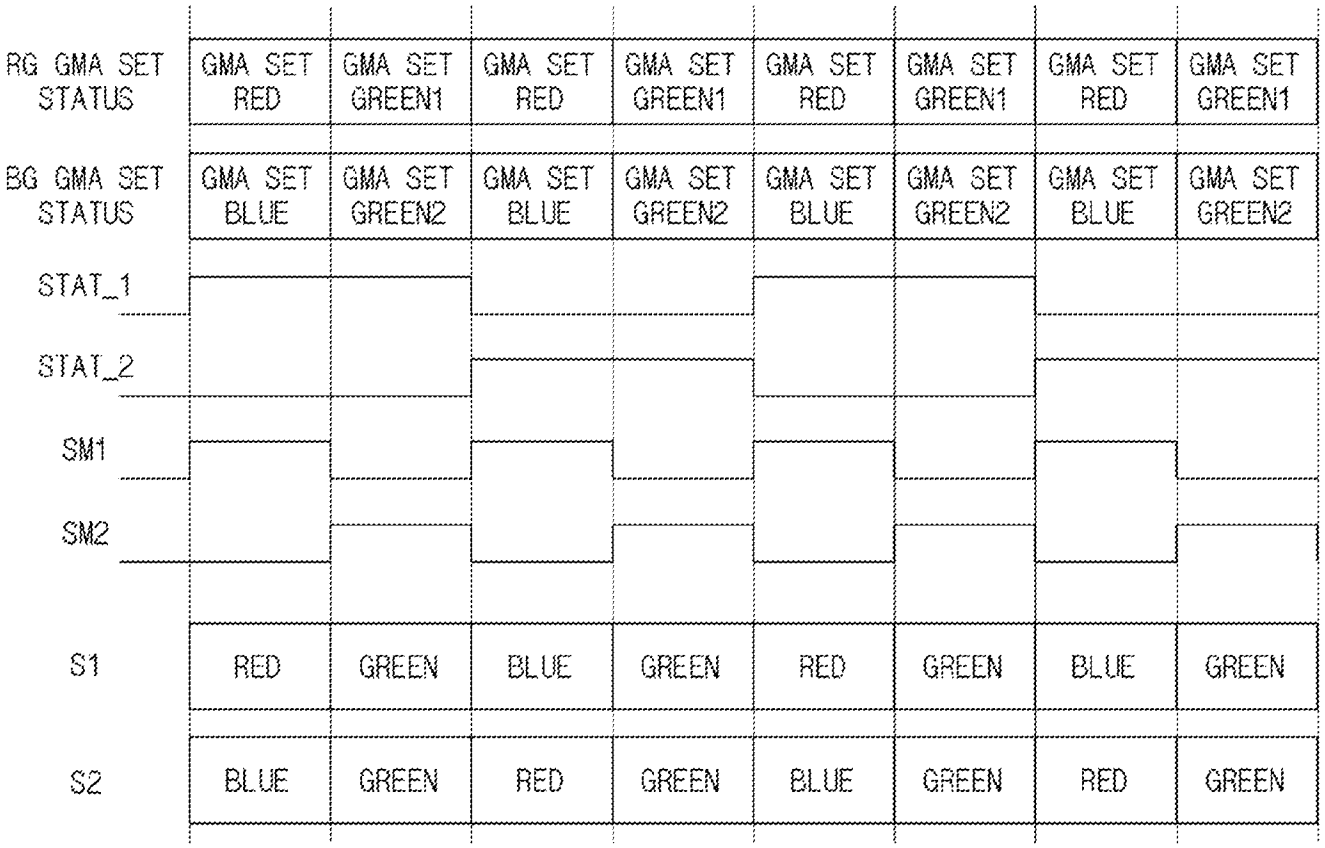
FIG. 3 is a driving timing diagram of gamma circuits and source channels illustrated in FIG. 2 in accordance with an embodiment of the disclosure.

FIG. 3 is a driving timing diagram of the gamma circuits and the source channels illustrated in FIG. 2 in accordance with an embodiment of the disclosure.

Referring to FIGS. 2 and 3, the first gamma circuit 32 may set gamma values to values corresponding to red or green in conformity with a switching operation of the first demultiplexer DE-MUX1 of the display panel 100.

For instance, the first gamma circuit 32 may set gamma values to values corresponding to red according to a first switching signal SM1, and may set gamma values to values corresponding to green according to a second switching signal SM2. The first and second switching signals SM1 and SM2 may be defined as signals for controlling switching operations of demultiplexers DE-MUX of the display panel 100 for implementation of rendering.

The second gamma circuit 34 may set gamma values to values corresponding to blue or green in conformity with a switching operation of the second demultiplexer DE-MUX2 of the display panel 100. For instance, the second gamma circuit 34 may set gamma values to values corresponding to blue according to the first switching signal SM1, and may set gamma values to values corresponding to green according to the second switching signal SM2.

The first source channel CH1 may change the first source driving signal S1 to a value corresponding to 'red and green' or 'blue and green' depending on first and second control signals STAT_1 and STAT_2. The first and second control signals STAT_1 and STAT_2 may be defined as signals whose logic levels are determined according to in change in a horizontal line of the display panel 100 to implement rendering.

The second source channel CH2 may change the second source driving signal S2 to a value corresponding to 'blue and green' or 'red and green' depending on the first and second control signals STAT_1 and STAT_2.

The first source amplifier AMP1 of the first source channel CH1 may change the value of the first source driving signal S1 by using the first gamma signal GMA1 corresponding to red and green or the second gamma signal GMA2 corresponding to blue and green, in response to the first and second control signals STAT_1 and STAT_2.

The second source amplifier AMP2 of the second source channel CH2 may change the value of the second source driving signal S2 by using the second gamma signal GMA2 corresponding to blue and green or the first gamma signal GMA1 corresponding to red and green, in response to the first and second control signals STAT_1 and STAT_2.

Figure 4:
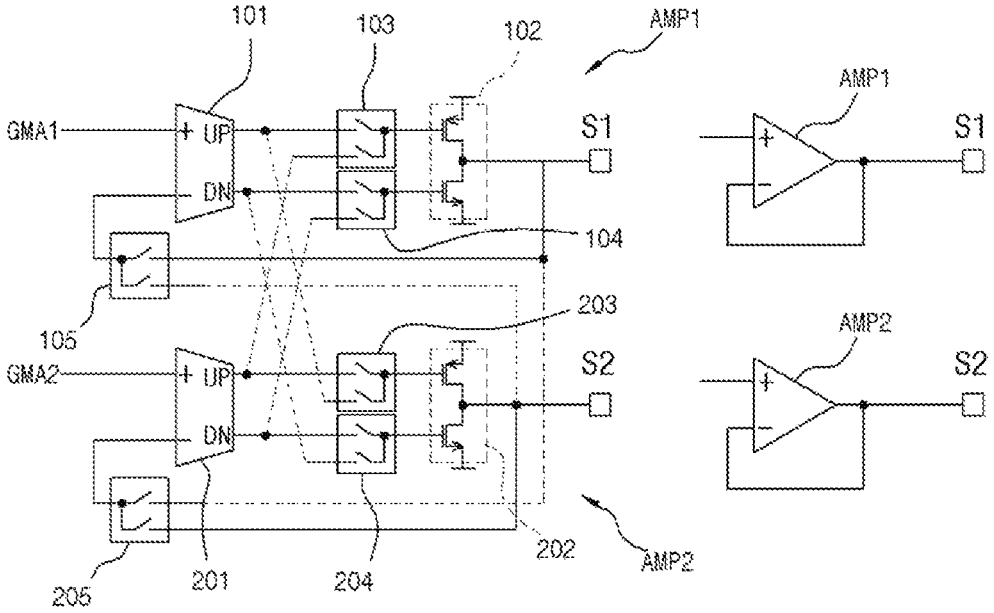
FIGS. 4 and 5 are circuit diagrams illustrating representations of examples of first and second source amplifiers in accordance with embodiments of the disclosure.
Figure 5:
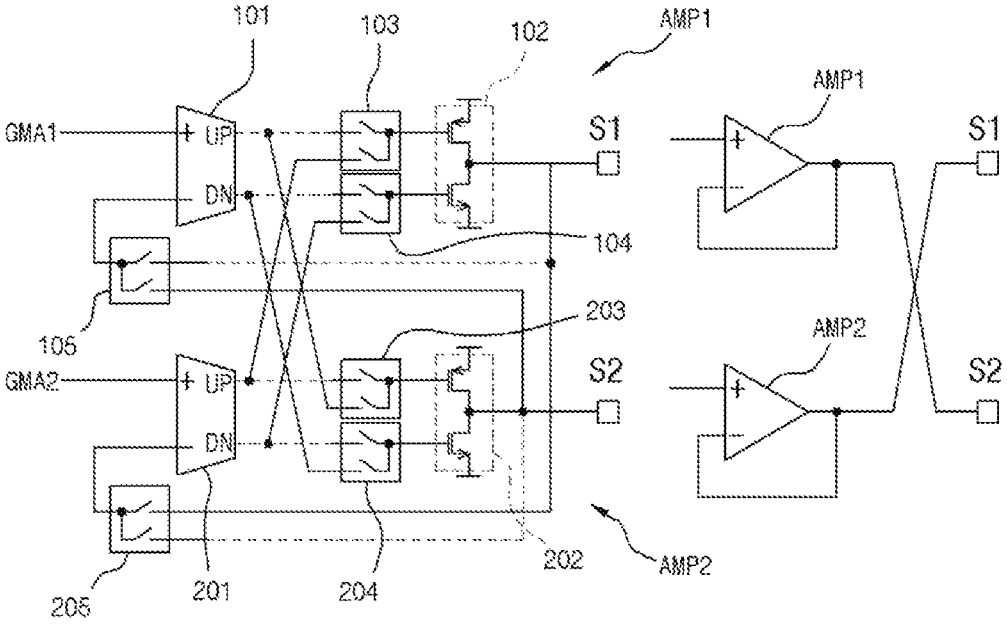

FIGS. 4 and 5 are circuit diagrams illustrating representations of examples of first and second source amplifiers in accordance with embodiments of the disclosure.

Referring to FIG. 4, the first source amplifier AMP1 includes a first internal amplifier 101, a first output circuit 102, and first to third switch circuits 103, 104 and 105.

The first internal amplifier 101 outputs the pull-up and pull-down signals UP and DN in response to the first gamma signal GMA1. The first output circuit 102 outputs the first source driving signal S1 in response to the pull-up and pull-down signals UP and DN.

The first switch circuit 103 is positioned between the first internal amplifier 101 and the first output circuit 102, and transfers, depending on a switching operation, the pull-up signal UP of the first internal amplifier 101 or the pull-up signal UP from the second source amplifier AMP2, to the first output circuit 102. The first switch circuit 103 performs the switching operation in response to the first and second control signals STAT_1 and STAT_2 (see FIG. 3).

The second switch circuit 104 is positioned between the first internal amplifier 101 and the first output circuit 102, and transfers, depending on a switching operation, the pull-down signal DN of the first internal amplifier 101 or the pull-down signal DN from the second source amplifier AMP2, to the first output circuit 102. The second switch circuit 104 performs the switching operation in response to the first and second control signals STAT_1 and STAT_2.

The third switch circuit 105 transfers, depending on a switching operation, the first source driving signal S1 outputted from the first source amplifier AMP1 or the second source driving signal S2 outputted from the second source amplifier AMP2, to a negative input terminal (−) of the first internal amplifier 101. The third switch circuit 105 performs the switching operation in response to the first and second control signals STAT_1 and STAT_2.

The first to third switch circuits 103, 104 and 105 may perform the switching operations in response to the first and second control signals STAT_1 and STAT_2 whose logics are determined according to change in a horizontal line of the display panel 100.

That is to say, the first source amplifier AMP1 outputs the first source driving signal S1, corresponding to 'red and green' or 'blue and green' depending on the switching operations of the first to third switch circuits 103, 104 and 105, to the display panel 100.

The second source amplifier AMP2 includes a second internal amplifier 201, a second output circuit 202, and fourth to sixth switch circuits 203, 204 and 205.

The second internal amplifier 201 outputs the pull-up and pull-down signals UP and DN in response to the second gamma signal GMA2. The second output circuit 202 outputs the second source driving signal S2 in response to the pull-up and pull-down signals UP and DN.

The fourth switch circuit 203 is positioned between the second internal amplifier 201 and the second output circuit 202, and transfers, depending on a switching operation, the pull-up signal UP of the second internal amplifier 201 or the pull-up signal UP from the first source amplifier AMP1, to the second output circuit 202. The fourth switch circuit 203 performs the switching operation in response to the first and second control signals STAT_1 and STAT_2.

The fifth switch circuit 204 is positioned between the second internal amplifier 201 and the second output circuit 202, and transfers, depending on a switching operation, the pull-down signal DN of the second internal amplifier 201 or the pull-down signal DN from the first source amplifier AMP1, to the second output circuit 202. The fifth switch circuit 204 performs the switching operation in response to the first and second control signals STAT_1 and STAT_2.

The sixth switch circuit 205 transfers, depending on a switching operation, the second source driving signal S2 outputted from the second source amplifier AMP2 or the first source driving signal S1 outputted from the first source amplifier AMP1, to a negative input terminal (−) of the second internal amplifier 201. The sixth switch circuit 205 performs the switching operation in response to the first and second control signals STAT_1 and STAT_2.

The fourth to sixth switch circuits 203, 204 and 205 may perform the switching operations in response to the first and second control signals STAT_1 and STAT_2 whose logics are determined according to change in a horizontal line of the display panel 100.

That is to say, the second source amplifier AMP2 outputs the second source driving signal S2, corresponding to 'blue and green' or 'red and green' depending on the switching operations of the fourth to sixth switch circuits 203, 204 and 205, to the display panel 100.

As such, the first and second source amplifiers AMP1 and AMP2 may change the first and second source driving signals S1 and S2 to values corresponding to 'red and green' or 'blue and green' depending on switching operations of switching circuits therein to implement rendering.

FIG. 4 illustrates operations in which the first source amplifier AMP1 provides the first source driving signal S1 by using the first gamma signal GMA1 and the second source amplifier AMP2 provides the second source driving signal S2 by using the second gamma signal GMA2.

In the case where the first gamma signal GMA1 is a signal corresponding to red and green and the second gamma signal GMA2 is a signal corresponding to blue and green, the first source amplifier AMP1 provides the first source driving signal S1 corresponding to red and green to the display panel 100 in response to the first gamma signal GMA1, and the second source amplifier AMP2 provides the second source driving signal S2 corresponding to blue and green to the display panel 100 in response to the second gamma signal GMA2.

FIG. 5 illustrates operations in which the first source amplifier AMP1 provides the first source driving signal S1 by using the second gamma signal GMA2 and the second source amplifier AMP2 provides the second source driving signal S2 by using the first gamma signal GMA1.

In the case where the first gamma signal GMA1 is a signal corresponding to red and green and the second gamma signal GMA2 is a signal corresponding to blue and green, the first source amplifier AMP1 provides the first source driving signal S1 corresponding to blue and green to the display panel 100 in response to the signals UP and DN corresponding to the second gamma signal GMA2 from the second source amplifier AMP2, and the second source amplifier AMP2 provides the second source driving signal S2 corresponding to red and green to the display panel 100 in response to the signals UP and DN corresponding to the first gamma signal GMA1 from the first source amplifier AMP1.

Figure 6:
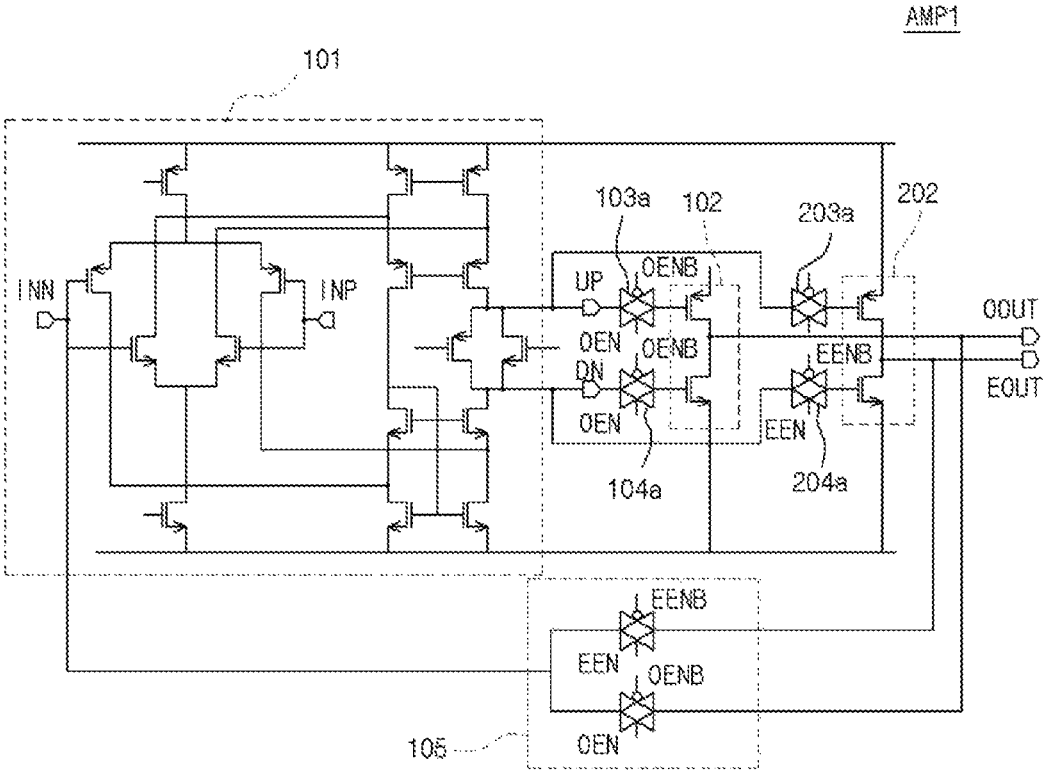
FIG. 6 is a diagram illustrating a representation of an example of an internal circuit of a source amplifier in accordance with an embodiment of the disclosure.

FIG. 6 is a diagram illustrating a representation of an example of a first source amplifier AMP1 in accordance with an embodiment of the disclosure.

Referring to FIG. 6, the first source amplifier AMP1 outputs a first output signal OOUT in response to input signals INN and INP. The first source amplifier AMP1 includes an internal amplifier 101, an output circuit 102, a switch circuit 105, and switches 103*a* and 104*a*. The internal amplifier 101 may be configured by a rail-to-rail amplifier, and respective switches may be configured by transfer gate elements.

On and off of each of the switches 103*a* and 104*a* may be determined depending on first enable signals OEN and OENB. The switch circuit 105 transfers the first output signal OOUT to the internal amplifier 101 in response to the first enable signals OEN and OENB, or transfers a second output signal EOUT to the internal amplifier 101 in response to second enable signals EEN and EENB. For example, the first enable signals OEN and OENB and the second enable signals EEN and EENB may be defined as signals that are alternately enabled in response to change in a horizontal line.

A switch circuit 202 and switches 203*a* and 204*a* illustrated in FIG. 6 may be understood as internal switches of a second source amplifier AMP2. The second source amplifier AMP2 outputs the second output signal EOUT.

As is apparent from the above descriptions, according to the embodiments of the disclosure, by removing a switch terminal positioned at an output terminal of a source amplifier, it is possible to eliminate a settling time issue by the influence of switch resistance.

Also, according to the embodiments of the disclosure, by implementing, in a source amplifier, a switch for changing a source driving signal of a channel, it is possible to minimize a reduction in settling time and an increase in chip area in the source amplifier.

Further, according to the embodiments of the disclosure, since the same operation is implemented by using two gamma circuits instead of gamma circuits corresponding to R, G and B, respectively, it is possible to reduce the chip area of a source driving circuit.

While various embodiments have been described above, it will be understood to those skilled in the art that the embodiments described are by way of example only. Accordingly, the disclosure described herein should not be limited based on the described embodiments.

What is claimed is:

1. A source driving circuit comprising:

a first source channel configured to convert first gamma values received from a first gamma circuit into a first gamma signal, and a second source channel configured to convert second gamma values received from a second gamma circuit into a second gamma signal, wherein each of the first source channel and the second source channel includes a source amplifier, the source amplifier comprising:

an internal amplifier configured to output a first pull-up signal and a first pull-down signal in response to the first gamma signal;

an output circuit configured to output a first source driving signal in response to the first pull-up signal and the first pull-down signal or second pull-up signal and second pull-down signal provided from the second source channel; and first and second switch circuits connecting the internal amplifier and the output circuit or the second source channel and the output circuit, and configured to transfer the first pull-up signal and the first pull-down signal corresponding to the first gamma signal of the first source channel or the second pull-up signal and the second pull-down signal corresponding to the second gamma signal of the second source channel, to the output circuit, wherein the first gamma circuit changes the first gamma values to values corresponding to red or green in conformity with a switching operation of a first demultiplexer of a display panel corresponding to the first source channel, wherein the second gamma circuit changes the second gamma values to values corresponding to blue or green in conformity with a switching operation of a second multiplexer of the display panel corresponding to the second source channel.

2. The source driving circuit according to claim 1, further comprising:

a third switch circuit configured to feed back the first source driving signal of the source amplifier or a second source driving signal of the second source channel, to the internal amplifier.

3. The source driving circuit according to claim 1, wherein the first and second switch circuits transfer the first pull-up signal and the first pull-down signal corresponding to the first gamma signal or the second pull-up signal and the second pull-down signal corresponding to the second gamma signal to the output circuit, by switching operations.

4. The source driving circuit according to claim 1, wherein the first source driving signal is set as a signal corresponding to 'red and green' or 'blue and green' depending on switching operations of the first and second switch circuits.

5. A source driving circuit comprising:

a first digital-analog converter configured to convert first gamma values received from a first gamma circuit into a first gamma signal;

a second digital-analog converter configured to convert second gamma values received from a second gamma circuit into a second gamma signal, a first source amplifier configured to receive the first gamma signal, and change a first source driving signal to a signal corresponding to 'red and green' or 'blue and green' by using a first pull-up signal and a first pull-down signal corresponding to the first gamma signal or a second pull-up signal and a second pull-down signal corresponding to the second gamma signal; and a second source amplifier configured to receive the second gamma signal, and change a second source driving signal to a signal corresponding to 'blue and green' or 'red and green' by using the second pull-up signal and the second pull-down signal corresponding to the second gamma signal or the first pull-up signal and the first pull-down signal corresponding to the first gamma signal, wherein the first gamma circuit changes the first gamma values to values corresponding to red or green in conformity with a switching operation of a first demultiplexer of a display panel corresponding to the first source channel, wherein the second gamma circuit changes the second gamma values to values corresponding to blue or green in conformity with a switching operation of a second demultiplexer of the display panel corresponding to the second source channel.

6. The source driving circuit according to claim 5, wherein the first source amplifier comprises:

a first internal amplifier configured to output the first pull-up signal and the first pull-down signal in response to the first gamma signal;

a first output circuit configured to output the first source driving signal in response to the first pull-up signal and the first pull-down signal;

a first switch circuit positioned between the first internal amplifier and the first output circuit, and configured to transfer the first pull-up signal or the second pull-up signal from the second source amplifier, to the first output circuit; and a second switch circuit positioned between the first internal amplifier and the first output circuit, and configured to transfer the first pull-down signal or the second pull-down signal from the second source amplifier, to the first output circuit.

7. The source driving circuit according to claim 6, further comprising: a third switch circuit configured to feed back the first source driving signal of the first source amplifier or the second source driving signal of the second source amplifier, to the first internal amplifier.

8. The source driving circuit according to claim 5, wherein the second source amplifier comprises:

a second internal amplifier configured to output the second pull-up signal and the second pull-down signal in response to the second gamma signal;

a second output circuit configured to output the second source driving signal in response to the second pull-up signal and the second pull-down signal;

a fourth switch circuit positioned between the second internal amplifier and the second output circuit, and configured to transfer the second pull-up signal or the first pull-up signal from the first source amplifier, to the second output circuit; and a fifth switch circuit positioned between the second internal amplifier and the second output circuit, and configured to transfer the second pull-down signal or the first pull-down signal from the first source amplifier, to the second output circuit.

9. The source driving circuit according to claim 8, further comprising: a sixth switch circuit configured to feed back the second source driving signal of the second source amplifier or the first source driving signal of the first source amplifier, to the second internal amplifier.

10. The source driving circuit according to claim 9, wherein the first source driving signal is selected as a signal corresponding to 'red and green' or 'blue and green' depending on switching operations of the first and second switch circuits of the first source amplifier.

11. The source driving circuit according to claim 10, wherein the second source driving signal is selected as a signal corresponding to 'blue and green' or 'red and green' depending on switching operations of the fourth and fifth switch circuits disposed in the second source amplifier.

* * * * *